US005154589A

United States Patent [19]

Ruhl et al.

[11] Patent Number: 5,154,589

[45] Date of Patent: Oct. 13, 1992

[54] METERING PUMP

[75] Inventors: Mark A. Ruhl; William M. Hamilton, both of Baltimore; John M. Bronw, Jr., Westminster; Richard N. Bennett, Sykesville, all of Md.

[73] Assignee: National Instrument Company, Baltimore, Md.

[21] Appl. No.: 610,955

[22] Filed: Nov. 9, 1990

[51] Int. Cl.[5] ..... F04B 7/00

[52] U.S. Cl. ..... 417/446; 417/454; 137/454.4; 137/332; 92/255

[58] Field of Search ..... 417/446, 454, 567; 137/454.4, 332, 331; 92/243, 255, 257

[56] References Cited

U.S. PATENT DOCUMENTS

| | | | |
|---|---|---|---|
| 867,997 | 10/1907 | Nelson et al. | 417/446 |
| 1,149,279 | 8/1915 | Nelson | 417/446 |
| 1,195,395 | 8/1916 | Preston | 92/257 |
| 1,441,646 | 1/1923 | Vaughan | 137/332 |
| 1,919,696 | 7/1933 | George | 137/332 |
| 2,045,196 | 6/1936 | Mohr | 92/257 |
| 2,109,785 | 3/1938 | Starr | 137/454.4 |
| 2,564,830 | 8/1951 | Bremser | 417/454 |
| 2,679,441 | 5/1954 | Stillwagon | 92/243 |
| 2,807,213 | 9/1957 | Rosen . | |
| 2,907,614 | 10/1959 | Rosen . | |
| 2,978,149 | 4/1961 | Rosen . | |
| 2,978,283 | 4/1961 | Rosen . | |
| 3,069,178 | 12/1962 | Rosen . | |
| 3,157,191 | 11/1964 | Garrett et al. | 137/332 |
| 3,197,285 | 7/1965 | Rosen . | |
| 3,425,410 | 2/1969 | Cammack | 417/446 |
| 3,771,908 | 11/1973 | Rosen . | |
| 4,055,281 | 10/1977 | Rosen et al. . | |
| 4,208,953 | 6/1980 | Prusic | 92/257 |
| 4,230,160 | 10/1980 | Buckley . | |
| 4,569,378 | 2/1986 | Berganty . | |
| 4,610,377 | 9/1986 | Radmussen | 417/454 |
| 4,650,151 | 3/1987 | McIntire | 137/81.2 |

FOREIGN PATENT DOCUMENTS

| | | | |
|---|---|---|---|
| 0369086 | 3/1932 | United Kingdom | 92/243 |

OTHER PUBLICATIONS

"Duckbills" 1982 Vernay Laboratories, Inc.

*Primary Examiner*—Richard A. Bertsch
*Assistant Examiner*—Michael I. Kocharov
*Attorney, Agent, or Firm*—Barnes & Thornburg

[57] ABSTRACT

A metering pump wherein the head is provided with internal threads terminating adjacent to internal shoulders at each of the pump cylinder, inlet valve and outlet valve ports. The cylinder, inlet valve and outlet valve each include a flange secured to the shoulder by a collar threadably received in each of the ports. O-rings are provided in a circumferential groove in the body or cylinder of the pump inlet valves and outlet valves downstream of the flange. A piston pump structure includes a bushing mounted to the piston rod between the piston head and a second breakaway stop connected to the piston rod. The piston head includes a plurality of circumferential grooves for receiving respectively a cup seal or an O-ring seal. A suck-back mechanism is provided in a bore in the head and includes a stem having an eccentric cam which interacts with the valve structure to adjust the degree of closure by rotation of the stem.

46 Claims, 4 Drawing Sheets

METERING PUMP

BACKGROUND AND SUMMARY OF THE INVENTION

The present invention relates generally to metering pumps and more specifically to a new design for a metering pump for use in a filling machine.

Pumping units which are used on filling machines generally include five major components, namely a head, a piston, a cylinder, an inlet valve and an outlet valve. The head has an internal chamber connecting the cylinder, inlet valve and outlet valve mounted at appropriate ports. In general, the head has been uniquely designed to receive specific pistons and cylinders, inlet valves and outlet valves. Similarly, the design of the five elements has been dictated by the material to be pumped.

The object of the present metering pump design is to provide ease of disassembly, interchangeable parts, eliminate liquid contact with threads, uniformity of design to reduce the number of parts being inventoried and similarly the cost, as well as the versatility of the system and to improve sealing. A metering pump should be designed to accommodate standard mechanically sealed piston/cylinder assemblies as illustrated in U.S. Pat. No. 2,978,283 as well as sealed piston assemblies as illustrated in U.S. Pat. No. 4,569,378. Although U.S. Pat. No. 2,978,283 shows a readily disassembled metering pump, the seals at the various ports are flat butt seals and their integrity is a function of the pressure brought to bear in the attachment of the inlet and outlet valves and the pump to the head. Similarly, it is noted that the inlet and outlet valves are of different structure.

As discussed in U.S. Pat. No. 3,069,178, the piston rod of the piston pump is received in a closed end cap of the piston's cylinder and requires special sealing or packing to seal the opening while allowing the piston rod to move relative to the cylinder. This is a variation of the usual filling unit which found a limited usage for filling glues, cements and similar products.

The piston rod has been made of two pieces such that the sealing on the Piston head is achieved by compressing the seal between two movable stops of the piston head. This is illustrated specifically in U.S. Pat. No. 2,907,614. This not only increases the number of parts and thereby the cost, but also requires a longer assembly and disassembly time.

The metering pump should be able to interchangeably accommodate the check valves as in U.S. Pat. No. 2,978,283 as well as the spool valve of U.S. Pat. No. 4,055,281. Similarly, it should accommodate duck-bill valves such as those available from Vernay Laboratories, Inc. as well as standard o-ring seals shown in U.S. Pat. Nos. 2,978,149 and 2,978,283. A slightly modified piston head will accommodate the original style "V"-type packing stack.

To increase its versatility, the metering pump should also provide the capability of including a suck-back device. Typical examples of suck-back devices are illustrated in U.S. Pat. Nos. 2,978,149; 3,771,908 and 4,230,160. In each of these devices, the suck-back mechanism requires a modification of the outlet valve, and therefore does not make the structure uniform to that of the inlet valve.

To achieve these and other objects, the head is provided with internal threads terminating adjacent to internal shoulders at each of the pump cylinder port, inlet valve port and outlet valve port. The cylinder, inlet valve and outlet valve each include an external shoulder or flange having a first face which is adjacent to the internal shoulder of the respective port. Preferably, a collar is threadably received in each of the ports and adjacent to the second face of the respective flange for securing the flange to the respective ports. While the head is made of metallic material, the collar is made of non-metallic or other appropriate material to prevent seizure or galling of the connection. This facilitates in the hand disassembly of the structure without the need of tools. O-rings are provided in a circumferential groove in the body or cylinder of the pump inlet valves and outlet valves downstream of or further into the head than the flange. This provides a sealant of the structure which is not dependent on the pressure of the attachment of the cylinder, inlet valve or outlet valve to the head and isolates threads from liquid flow. The flange provided on the cylinder, inlet valve and outlet valve may include a ring extending from a circumferential groove in the body of the pump inlet valve or outlet valve. This permits minor modification of the existing structure without developing new tooling to provide the flange.

A single head design is capable of accommodating both standard mechanically sealed and diaphragm type cylinders, as well as check valves, duck-bill valves and spool valves.

A unique piston pump structure includes a cylinder closed at one end at the pump port by the head. The piston assembly includes a piston rod and a piston head removably mounted at a first end of the piston rod. A bushing is mounted to the piston rod adjacent to the first end of the piston rod. The second end of the cylinder is open. The piston head acts as a first stop for the bushing and a second breakaway stop is connected to the piston rod. The piston head includes a plurality of circumferential grooves for receiving respectively a cup seal, an o-ring seal or self-loading piston packing sets. At least one of the seals is in at least one of the grooves. This allows versatility of sealing design with a single piston head.

The inlet and outlet valves each include an identical first body member having a first valve seat adjacent to its first end and an identical second body member having a second valve seat adjacent to its first end. The first and second body members mate at their second ends and the first end of the first body member is received in the valve port. The inlet and outlet valves each include an identical check valve structure which is positioned in the inlet valve body members to seal on the second seat of the second body member and the check valve structure is positioned in the outlet valve body members to seal on the first valve seat of the first body member. This allows uniformity of the inlet and outlet valve structure to reduce the number of parts. The only difference is the positioning of the check valve structure which could include a ball and a biasing spring or weight or a poppet and spring.

The poppet includes a seal head of a first diameter and a stem of a second diameter smaller than the first diameter extending therefrom. The spring surrounds the stem and extends between the head and a valve seat. The stem has deep grooves defining a low helix along its length so as to rotate the poppet with fluid flowing, thereby cleaning the valve seat. Also the depth of the grooves prevents the stem from closing off the opposing valve seat during high pressure as well as preventing the spring from collapsing sufficiently to cut off the flow.

To incorporate the unique assembly and sealing structure previously discussed, the first body member would have a first flange with a first face adjacent to the internal shoulder of the valve port. The second body member would include a second flange adjacent to the second end of the second body member and having a first face received by the second end of the first body member. A collar is threadably received in the valve port adjacent to the second face of the first and second flanges for securing the first and second flanges to the valve port.

Inlet and outlet valves may also include a spool valve having first and second housing portions received in the inlet and outlet valve ports and a spool therein. The spool includes three components namely, a first and second end spool element separated at their first ends by a third or middle spool element. A connecting rod connects the three spool elements together. First and second circumferential grooves in the second end of the first and second spool elements have seals therein. The third and fourth circumferential grooves are defined between the first end of the first and second spool elements and the third spool element. A seal is also provided in the third and fourth circumferential grooves. Preferably the seal in the first and second circumferential grooves are o-rings whereas the seal in the third and fourth circumferential grooves are cup seals. An air cylinder or driver is mounted to the valve housing and is connected to the spool by a connector or coupling which may be removed without tools. The coupling includes a male and female member which are locked to each other in a coaxial position and are separable at a non-coaxial position.

To maintain uniformity of the body members of the first inlet and outlet valves, the capability of providing a suck-back mechanism is provided in a bore in the head versus the body structure of the outlet valve. The suck-back adjustment includes a stem extending from the exterior of the head into the interior of the head to interact with the outlet valve to adjust the degree of closure of the valve by moving the stem relative to the head. Preferably, the stem includes an eccentric cam which interacts with the valve structure to adjust the degree of closure by rotation of the stem. A locking device is provided to lock the stem with respect to the body after adjustment. An indicator is also provided on the stem, external of the body, for indicating the angular position of the stem.

The suck-back valve structure may be provided in a separate and distinct valve wherein the stem extends through a portion of the body of the valve structure and includes the unique eccentric cam to interact with the valve member to adjust the degree of closure of the valve by rotating the stem. Also, the suck-back valve can be used in the nozzle.

Other objects, advantages and novel features of the present invention will become apparent from the following detailed description of the invention when considered in conjunction with the accompanying drawings.

DETAILED DESCRIPTION OF THE DRAWINGS

Figure 1:
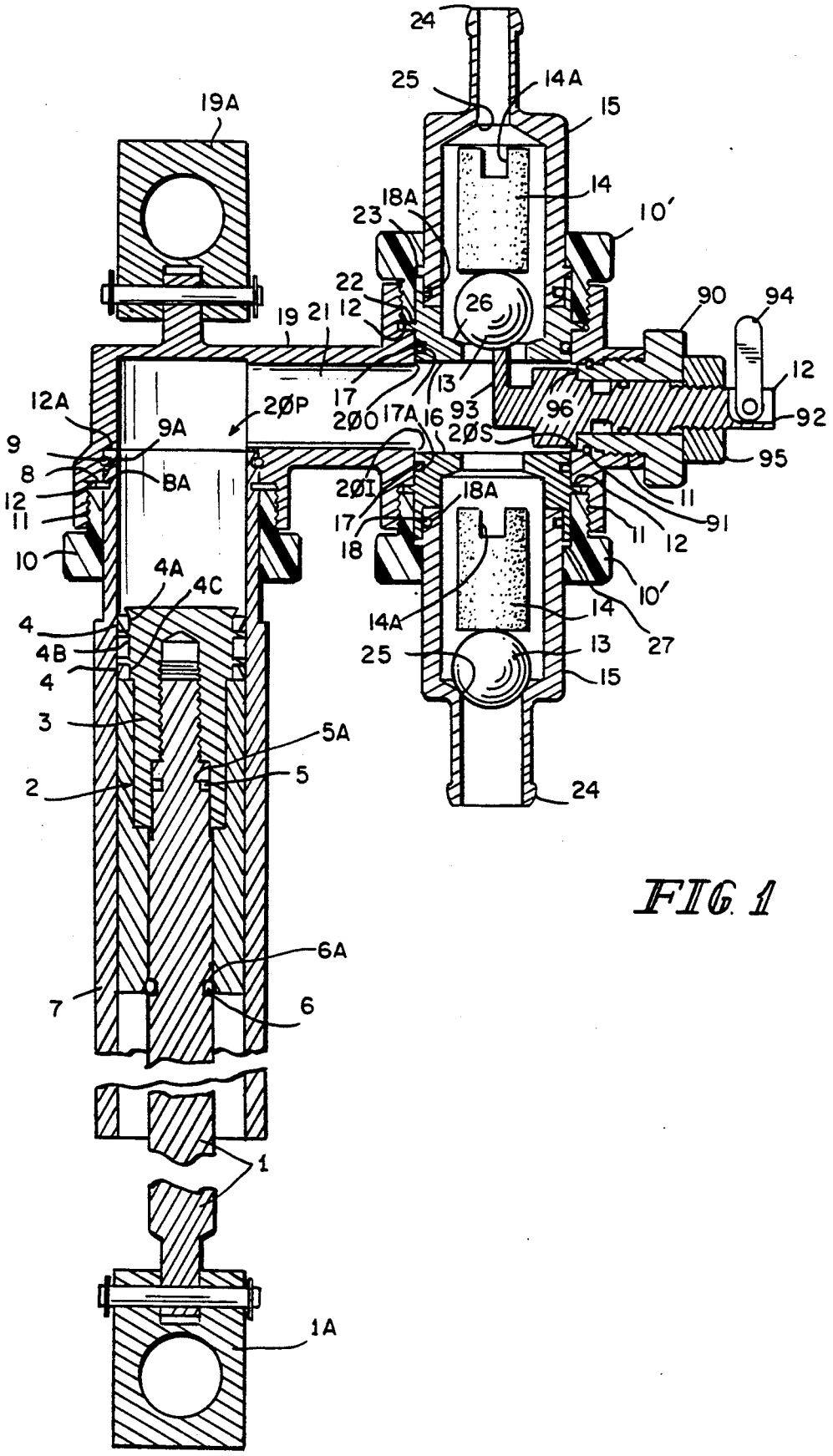
FIG. 1 is a cross-sectional view of a metering pump according to the principles of the present invention including a piston pump, check valves and suck-back device.

An embodiment illustrated in FIG. 1 shows a metering pump including a piston pump, check valves and a suck-back adjustment device. The metering pump includes a head 19 which includes a pump port 20P, an intake valve port 20I and an outlet valve port 20O, all interconnected by a chamber 21. A bore 20S is also provided in the head 19 to accommodate a suck-back device. Each of the ports and bore 20 include an internally threaded portion 11 terminating in an internal shoulder 12. A collar 10 is threadably received in the ports 20 and secures the pump, inlet valves and outlet valves to their respective ports by engaging and securing a flange of the pump, inlet valve and outlet valve to the shoulder 12. Preferably, the head 19 is a metal casting with the collar 10 being plastic. This prevents galling and seizure as well as ease of assembly. By using coarse threads and external knurls, collars 10, 10' may be removed by hand.

The piston pump includes a cylinder 7 being received in the pump port 20P having a first end resting against a second internal shoulder 12A of the pump port 20P. The other end of the cylinder 7 is open. A flange 8 extends from the first end of the cylinder and is shown as including a ring received in a circumferential groove 8A. An o-ring 9 extends from a second circumferential groove 9A in the cylinder 7 downstream from the flange 8 and adjacent to to the shoulder 12A. The collar 10 engages one face of the flange 8 and secures it against the shoulder 12. By using the o-ring 9 in a circumferential groove, the seal of the cylinder 7 to the pump port 20P is not a function of the compressional force of the collar 10 and also serves to isolate the threads from the liquid stream.

Figure 2:
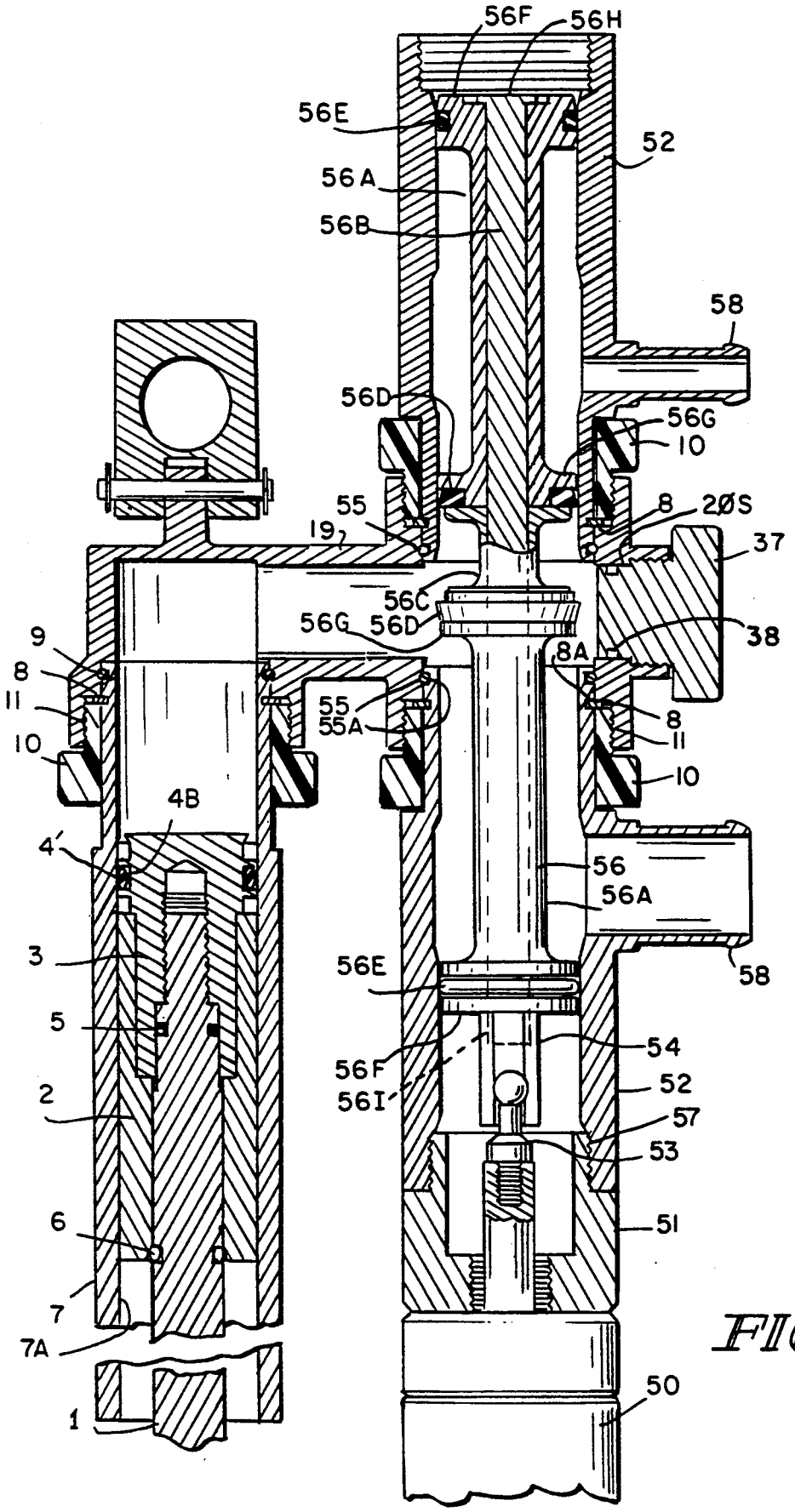
FIG. 2 is a cross-sectional view of a metering pump according to the principles of the present invention with a piston pump and a spool valve.

The piston includes a piston rod 1 with a piston head 3 mounted thereon. An o-ring 5 and a circumferential groove 5A of the piston rod 1 seals the interconnection of the piston head 3 to the piston rod 1. The piston head 3 includes three circumferential grooves 4A, 4B and 4C which are designed to receive the seal between the piston head 3 and the interior surface of the cylinder 7. Whereas circumferential grooves 4A and 4C are to receive oppositely directed cup seals, the center groove 4B accommodates an o-ring seal. The top groove 4A is substantially open at its top side to allow a cup seal to be slipped over the end of the piston head 3. Groove 4C at its bottom side is closed by the top face of the guide bushing 2. Since the piston head 3 is threadably received onto the piston rod 1, the lower cup seal can be positioned on the piston head 3 in slot 4C between it is threaded onto the piston rod 1. It is this particular structure of the piston head and rod which allows the use of cup seals. As illustrated in FIG. 1, two opposed cup ring seals 4 are shown in grooves 4A and 4C. An o-ring 4' is illustrated in FIG. 2 being in groove 4B.

Mounted to the piston rod 1 is a guide bushing 2. The guide bushing 2 is retained at one end by the piston head 3 and at another end by a breakaway stop 6. Stop 6 is an o-ring in a circumferential groove 6A in the piston rod 1 and is designed to vertically shear in the event of binding between the guide bushing 2 and the inner wall of the cylinder 7. Mounting the guide bushing 2 on the piston and leaving the end of the cylinder open, the pump is easily dismantled by merely pulling the piston rod 1 and removing the piston from the cylinder. The seals may be readily changed on the piston head without disassembling the whole metering pump. This structure mounting the guide bushing 2 to the piston rod can also be used with pre-loaded packing style piston heads.

A swivel 1A connects the piston rod 1 to either a driving source or a static portion of the filling unit and swivel 19*a* connects the head 19 to the other of the drive source or a static point of the filling unit. Thus piston rod 1 and piston head 3 move relative to the cylinder 7.

The inlet and outlet valves illustrated in FIG. 1 are check valves of the ball variety. Each of the valves are formed from identical elements and include a first body member 16 having a first end received in the valve ports 20 and includes a first valve seat 26. The second valve body member 15 includes a second valve seat 25 at its first end adjacent to an outlet or nipple 24. The first and second valve body members 16, 15 are mated at their second end. The first valve member 16 includes a flange 22 resting upon the internal shoulder 8 of the valve port 20. The second valve body element 15 includes a flange 23 resting upon the first valve body portion 16. The collar 10' engages both flanges 22, 23 and secures the flanges and the valve body members 15, 16 to the head 19 at port 20. It should be noted that collar 10' has basically the same function and structure as 10 but includes an internal shoulder 27 to receive the flange 23 of the second valve body member 15.

An o-ring 18 in circumferential groove 18A of the second body portion 15 seals the mating of the second ends of the first and second body members 16, 15. An o-ring 17 in circumferential groove 17A of the first body member 16 seals the first body portion to the Port 20. Both of the circumferential grooves and o-rings are downstream from or further interior the port than their respective flanges. It should be noted that the o-ring 18 has a higher compressional seal than the o-ring 17 so that removal of the valve body members 15, 16 will come out as a single insert upon removal of the collar 10'. This will maintain the check valve members within the chamber and prevent them from falling out. Subsequent to removal from the head 19, the two body members 15, 16 can be separated from each other to replace one of the members to provide a new valve seat or the check valve elements.

The check valve elements include a ball 13 and a weight 14. An X-shaped channel 14A is provided in the end of the weight 14 to allow flow if the weight 14 engages one of the valve seals. It should be noted that the weight 14 may be replaced by springs if desired. The inlet valve at inlet port 20I positions the weight 14 above the ball 13 such that ball 13 seats on the second valve seat 25 of the second member 15. The outlet valve has its ball 13 and weight 14 positioned such that the ball 13 seals against the first valve seat 26 of the first member 16. Thus it can be seen, that the elements of the inlet and outlet valve are identical and the difference is only in the positioning of the weight 14 and the ball 13 such that they seal on different valve seats. This reduces the inventory of elements that must be available and standardizes and modularizes the construction.

As an alternative, the first valve body members 16 may be identical, with the second valve body member 15 being specifically designed for the inlet and outlet valve. For example, the inlet valve portion may include a larger diameter nipple 24 than that of the outlet valve. This would reduce the interchangeability of at least the second portion and only slightly increase the part count.

Figure 4:
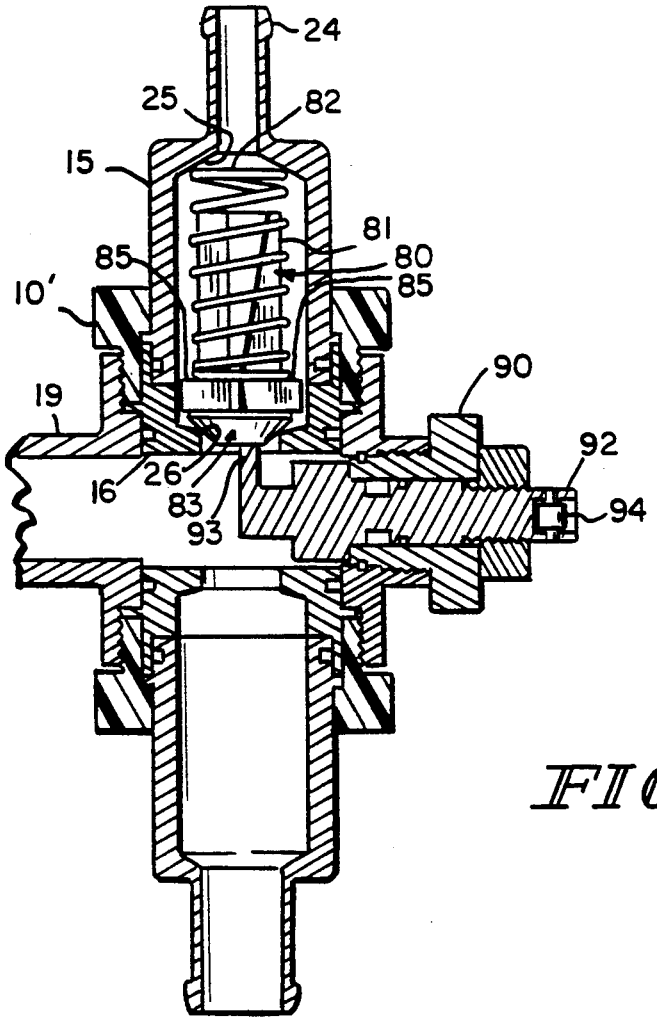
FIG. 4 is a cross-sectional view of a metering pump according to the principles of the present invention including a poppet valve.
Figure 5:
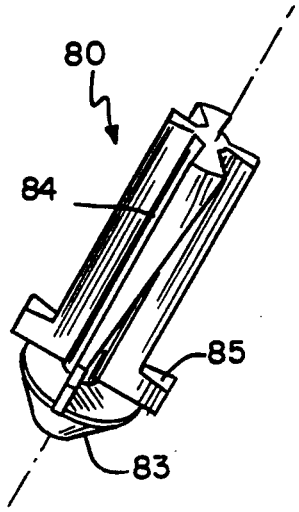
FIG. 5 is a perspective view of the poppet body.

As an alternative to the ball and weight configuration of FIG. 1 and a ball and spring configuration, a special tappet valve configuration is illustrated in FIGS. 4 and 5. In high pressure situations, a ball does compress the spring closing it completely. This offers a barrier about the opposite port which is not sealed by the ball. The X channel 14A in the weight provides exit of the fluid. The poppet assembly of FIGS. 4 and 5 offer even further improvements. Tappet assembly 80 includes a body or stem 81 having low helical grooves 84 therein which terminate in a shoulder section 85 extending radially therefrom. Shoulder 85 provides a seat for the spring 82. A tip sealing element 83 is mounted to the tappet body 81 below the shoulders 85. The main body 81 may be cast stainless steel or a plastic molded body and the tip sealing element 83 may be Viton or other elastomeric compounds molded on the end. The helical grooves 84 promote rotation of the poppet 80 by the moving fluid. This rotation, in turn, while slight, aids the poppet in keeping the valve seat 25, 26 clean of particulate matter. As can be noted in FIG. 5, the helical grooves 84 are sufficiently large such that the cross-section of the body 81 is generally T-shaped. Thus when the body 81 comes to rest against the valve seat opposite to the tip sealing element 83, it does not restrict flow through that port.

An adjustable suck-back assembly is shown mounted in the suck-back bore or port 20S of the head 19. The adjustable suck-back device interacts with the check element, namely ball 13 to adjust the degree of closure of the outlet valve. By providing the suck-back adjustment in the head 19 instead of the body portion of the outlet valve, the outlet valve housing structure may be identical to that of the inlet valve housing structure. This again reduces the number of parts and the dedication of a part to one of two substantially equivalent functions.

The suck-back assembly includes a body 90 threadably received in the suck-back port or bore 20*s* and includes an o-ring 91 in a circumferential groove of the body 90. A stem 92 extends from the exterior of the head 19 to the interior and terminates with an eccentric cam 93 which interacts with the check valve element or ball 13. The stem 92 is movable relative to the body 90 and the head 19 to adjust the degree of closure of the outlet valve by rotation of the stem. An adjusting lever and indicator 94 is provided on the stem 92 to adjust the angular position and to indicate the angular position of the cam. This provides an external indication of the degree of closure or suck-back of the outlet valve. A lock nut 95 is threadably received on a threadable portion of the stem 92 and clamps mating shoulders 96 of the stem 92 to the body 90 to lock it in place at a specific angular position after adjustment.

Whereas the suck-back device in FIG. 1 is shown in its fully open position, the suck-back device in FIG. 4 is shown in its closed position.

Figure 3:
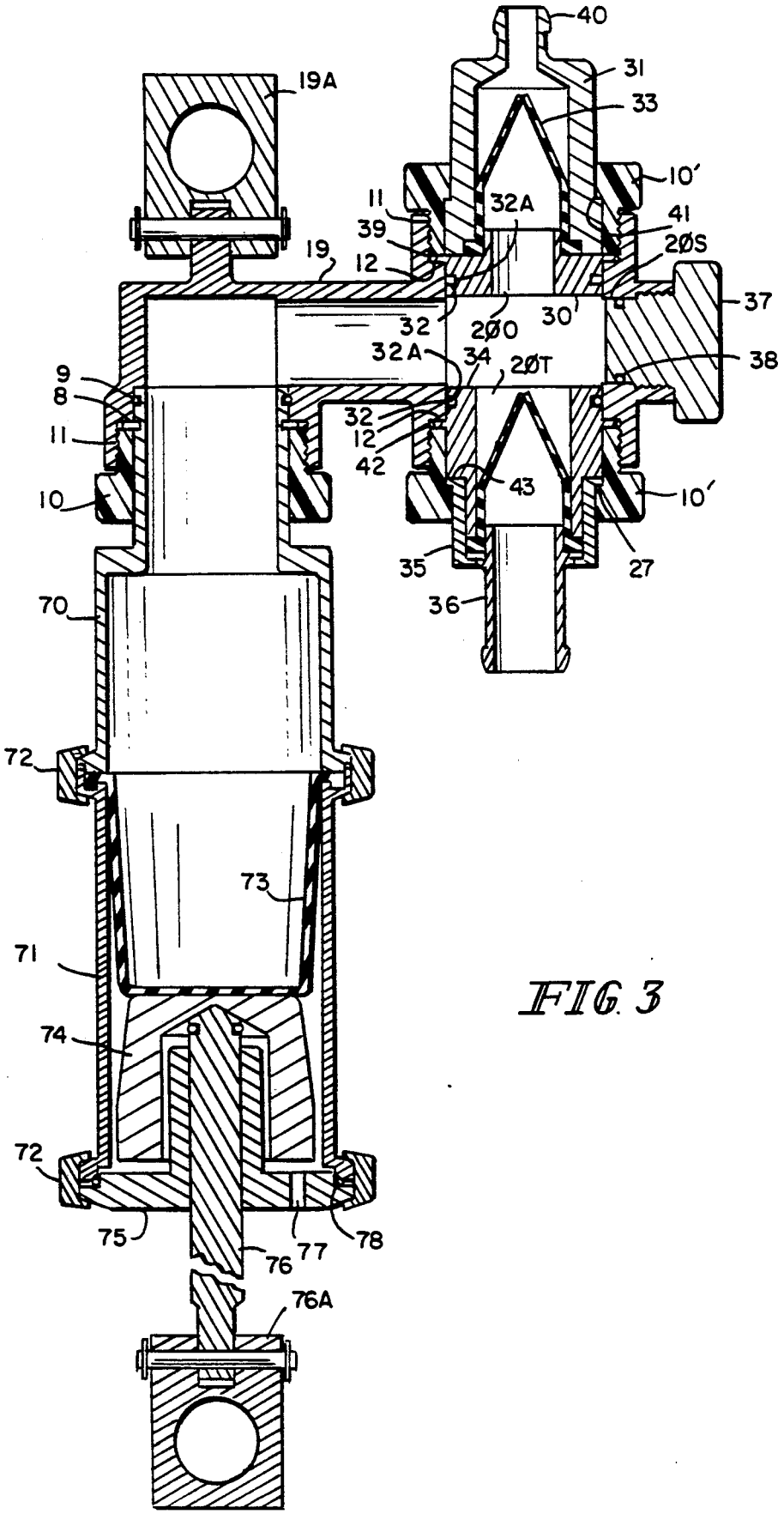
FIG. 3 is a cross-sectional view of a metering pump according to the principles of the present invention including a diaphragm pump and duck-bill valves.

As illustrated in FIGS. 2 and 3, a plug 37 with an o-ring 38 in a circumferential groove can be received in the suck-back port 20S when the suck-back mechanism is not present. The plug 37 provides readable access to the chamber 21 without disassembly of the inlet or outlet valves or the pump for cleaning and inspection of the chamber. As with the sealing at the other ports, the o-rings 91, 38 are downstream from or further interior than the threaded portion of the port 20S.

Although the specific suck-back arrangement illustrated in FIG. 1 wherein the suck-back structure is mounted to the head 19 instead of the valve body is preferred, the specific suck-back structure with the eccentric cam may be provided directly to the valve body if desired and would still be considered an improvement over the structures illustrated in U.S. Pat. No. 3,771,908 and 4,230,160. This will increase the number of parts and not make the inlet and outlet valves interchangeable, but will still provide an improved suck-back adjustment for a valve in a pumping system. Also, the specific suck-back structure can be part of the nozzle.

The inlet and outlet valve may be a spool valve as illustrated in FIG. 2. The operation of the system may be a double acting air valve system as illustrated in U.S. Pat. No. 4,055,281 or a single air cylinder as illustrated in FIG. 2. Singular air cylinder or driver 50 is connected by an adapter 51 to the spool casing 52. Adapter 51 is threadably received at 57 to the spool casing 52. The adapter 51 may be mounted to the cylinder 50 or be an integral portion thereof. The double acting air cylinder 50 is connected to the spool assembly 56 by a male ball coupling 53 threadably mounted to the air cylinder 50 and a female hex coupling 54 threadably mounted to the spool assembly 56. The male and the female couplings are locked to each other in a coaxial position and are separable when moved into a non-coaxial position. This allows quick disconnection of the air cylinder 50 from the spool valve without a tool and allows the spool valve to be removed from the head 19 without removing the head and the remainder of the metering pump from the machine. Thus the spool valve can be inspected without major diassembly of the metering pump.

To replace the spool 56, the adapter 56 and cylinder 50 are threadably removed from the housing 52 drawing the spool 56 therewith. Once the connection between the male ball coupling 53 and the female hex coupling 54 is exterior the housing 52, the air cylinder 50 is rotated transverse to the axis of the spool through a slot allowing removal of the male ball 53 from the female hex coupling 54. A new spool may then be mounted to the end of the male ball coupling 50 and reinserted into the housing. The particular male ball coupling 53 and female hex coupling 54 allows a toolless connection between the cylinder 50 and the spool 56. Thus the spool can be replaced in a matter of minutes without dismantling the pump system from the machine and therefore allow the filling system to be down for a minimum amount of time.

The spool assembly 56 includes a pair of end sections 56A and a center section 56C held together by a spool connecting rod 56B. One end of the connecting rod 56H is received in a recess in an end flange 56F of one of the end spool sections 56A and it opposite end terminates in a threaded section 56I. The female hex coupling 54 is threaded to the threaded end 56I thereby securing the spool sections 56A, 56C between the end 56H and the hex 54. The exterior end flanges 56F of the end spool sections 56A have o-rings 58 thereon. Cup seals 56D are provided between the interior flanges 56G of the end spool sections 56A and the center spool section 56C. Since the spool assembly 56 is disassemblable, cup seals 56D can be used. In the prior art, o-ring seals had to be used at the center pole sections as shown in U.S. Pat. No. 4,055,281 to Rosen et al.

The spool casing 52 received in the inlet and outlet ports 20 are identical and include nipples 58. The other end of spool casing 52 includes a flange 8 illustrated as a ring extending from a circumferential groove 8A to be received at the shoulder 12 of the valve ports. An o-ring 55 in a second circumferential groove 55A downstream from or further interior than the flange 8 seals the casing 52 to the valve port. A collar 10 is threadably received at 11 at the valve port and secures the flange 8 and the casing 52 to the valve ports 20.

As in the previous embodiments, the collar 10 is of plastic whereas the casing 19 is of metal and therefore allows a non-galling connection. Similarly, it provides the ease of disassembly without a tool. By using the ring 8 as the flange, a standard non-threaded spool casing 52 can be used and modified by merely providing the two circumferential grooves to accommodate the flange 8 and the o-ring 55. Also as previously discussed, by providing the o-ring 55 in a circumferential groove and downstream from flange 8, the sealing is independent of the compression pressure used to mount the flange 8 and casing 52 to the valve port and serves also to isolate threads from the liquid stream.

As with the inlet and outlet valves of FIG. 1, the spool casing 52 is designed to be interchangeable whether it is used for the inlet or outlet valve as well as the portion of the spool valve assembly 56. The only difference which may be provided and would reduce the interchangeability is to provide different sized nipples 58 on the inlet and outlet valve portions.

As previously discussed, an o-ring 4' is illustrated as being provided in the groove 4B on the piston head of the piston pump in FIG. 2 compared to the cup seals for the piston pump head in FIG. 1.

Instead of the ball valves illustrated in FIG. 1, the check valves may also be duck-bill valves as illustrated in FIG. 3. The outlet duck-bill valve includes an upper insert 30 having an o-ring 32 in a circumferential groove 32A downstream from or further interior than a flange 39 which is received on the shoulder 12 of the outlet valve port 20O. The upper valve body 31 includes a nipple 40. The duck-bill valve element 33 or diaphragm is sandwiched between the upper valve body 31 and the upper insert 30. A collar 10' engages a shoulder 41 of the upper duck-bill body 31 and flange 39 of the insert 30 and secures them to the outlet valve port 20O.

The inlet duck-bill valve includes a lower insert 34 having an o-ring 32 in circumferential groove 32A and a flange 43 which rests on the internal shoulder 12 of the inlet valve port 20I. A lower valve body 35 mates with the lower insert 34. A barb or nipple 36 is provided as a separate element. The barb 36 and the duck-bill valve 33 are sandwiched between the lower insert 34 and the lower valve body 35. The collar 10' engages a flange 43 on the lower valve body 35 and the flange 42 of the lower insert 34 and secures them to the inlet valve port 20I. It should be noted that the barb 36 may be made integral with the lower body portion 35.

Although the lower or inlet duck-bill structure is not identical and using the same elements as the upper or outlet duck-bill structure, both the duck-bill housing or bodies are designed such as to incorporate the unique mounting of the duck-bills to the inlet and outlet ports by using a plastic collar 10 received in the metal head 19, securing the valve body to the port by flanges and the use of o-ring seals in circumferential grooves beyond the flange connection. Although the duck-bill in FIG. 3 is illustrated with a diaphragm pump, it may be used with the piston pump illustrated in FIG. 1.

A diaphragm pump as described in U.S. Pat. No. 4,569,378 is shown in FIG. 3. The pump includes a cylinder 71 connected to an adapter 70 by clamp 72. The adapter 70 includes a flange 8 and o-ring seal 9 to be received in a standard sized pump port 20P of the head 19. The size of port 20P is that for a standard cylinder 7 of a piston pump. The adapter 70 allows the mounting of the larger diameter diaphragm pump cylinder 71 to the standardized hole. The rolling diaphragm is secured at the joinder of the adapter 70 and the cylinder 71. Piston head 74 is secured to a piston rod 76 which extends through a bearing cap and piston guide 75. A clamp 72 secures the bearing cap 75 to the cylinder 71. A vacuum port 77 is provided on the bearing cap 75 and an o-ring 78 is provided between the joinder of the bearing cap 75 and the cylinder 71. A swivel 76*a* connects the piston rod 76 to either a static portion or the drive member.

It should be noted that the bearing cap and guide 75 is that part which is eliminated from the cylinder 7 in FIG. 1 by providing the bushing 2 mounted directly to the piston rod 1.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A metering pump comprising:

a head having an internal chamber interconnecting a pump port, an inlet valve port and an outlet valve port of said head;

each of said ports including an internal shoulder;

a pump cylinder, an inlet valve and an outlet valve each including at a first end a flange having a first face adjacent to said internal shoulder of a respective port; and a collar independent of said cylinder, inlet valve and outlet valve, being received in said port adjacent to a second face of said flange and being secured to said head for securing said cylinder, inlet valve and outlet valve to a respective port;

said cylinder, inlet valve and outlet valve extend from a respective port through a respective collar.

2. A metering pump according to claim 1 wherein said cylinder, inlet valve and outlet valve each include an o-ring extending from a circumferential groove in said cylinder, inlet valve and outlet valve respectively adjacent to said first end and between said internal shoulder and said internal chamber.

3. A metering pump according to claim 1 wherein said flange on said cylinder is a ring extending from a first circumferential groove in said cylinder.

4. A metering pump according to claim 3 including an o-ring extending from a second circumferential groove in said cylinder, inlet valve and outlet valve between said first end and said flange.

5. A metering pump according to claim 1 wherein said head is metallic and said collar non-metallic or other appropriate material to render the threaded joint free from galling.

6. A metering pump according to claim 1 wherein said pump port is sized to receive standard piston pump cylinders, and said pump is a diaphragm pump having a cylinder with a first end adapted to be received in said pump port.

7. A metering pump according to claim 1 wherein said inlet and outlet valves are from a group consisting of check valves, duck bill valves and spool valves and said valve ports have a single design to accept all of said valves.

8. A metering pump according to claim 1 wherein said head includes:

a bore adjacent to said outlet port for receiving a suck-back adjustment device and for receiving a plug threadably received in said bore when no suck-back device is present; and a suck-back device having a body threadably received in said bore and a stem extending from the exterior of said head into the interior of said head for interacting with said outlet valve to adjust the degree of closure of the outlet valve.

9. A metering pump according to claim 8 wherein said outlet valve is a check valve, and said stem includes an eccentric cam which interacts with said check valve to adjust the degree of closure of said check valve by rotating said stem.

10. A metering pump according to claim 1 wherein said inlet and outlet valves include a spool valve comprising:

a first and second housing mounted to said inlet and outlet valve ports respectively;

a spool in said housings including a first end section, middle section and second end section of a first diameter separated by third and fourth sections of a second diameter smaller than said first diameter; and sealing means in circumferential grooves on said first and second end sections and a pair of cup seals in circumferential grooves in said middle section.

11. A metering pump according to claim 10 wherein:

said first end section, said third section and a first portion of said middle section is a unitary first spool element;

said second end section, said fourth section and a second portion of said middle section is a unitary second spool element;

a third portion of said middle section is a third spool element and forms said circumferential grooves with said first and second portions of said middle sections; and a rod connecting said first, second and third spool elements together.

12. A metering pump according to claim 1 wherein said inlet and outlet valves include a spool valve comprising:

first and second housings mounted to said inlet and outlet valve ports respectively;

a spool in said housing;

a driver means connected to said housing; and coupling means, removable without a tool, connecting said driver means to said spool.

13. A metering pump according to claim 1 wherein:

said cylinder is mounted to and closed at a first end by said head and a piston is movable in said cylinder;

said piston includes a piston rod and a piston head removably mounted to a first end of said piston rod; and a bushing mounted to said piston rod adjacent to said first end of said piston rod.

14. A metering pump according to claim 13 said piston head is a stop for one end of said bushing, and including a break-away stop connected to said piston rod as a stop for a second end of said bushing.

15. A metering pump according to claim 13 wherein said piston head includes a plurality of circumferential grooves for receiving respectively a cup seal, an o-ring seal or self-loading piston packing sets, and at least one of said seals is in at least one groove.

16. A metering pump according to claim 13 wherein said piston head includes a first circumferential groove having a cup seal therein and a second circumferential groove with a side formed by said bushing and having a cup seal therein.

17. A metering pump comprising:

a head having an internal chamber interconnecting a pump port, an inlet valve port and an outlet valve port of said head;

a pump cylinder, an inlet valve and an outlet valve removably mounted in said pump port, said inlet valve port and said outlet valve port respectively;

said inlet and outlet valves each include a first body member having a first flange adjacent to a first end, and a second body member having a first end receiving said first end of said first body member and a first face of said first flange;

said second body member having a second flange with a first face adjacent to a shoulder of said valve port; and said mounting means adjacent to a second face of said first and second flanges for securing said first and second flanges to a respective port.

18. A metering pump according to claim 17 wherein said second body members each include an o-ring extending from a circumferential groove in said second body member between said flange and said first end.

19. A metering pump comprising:

a head having an internal chamber interconnecting a pump port, an inlet valve port and an outlet valve port of said head;

a cylinder mounted to and closed at a first end by said head at said pump port;

a piston movable in said cylinder;

said piston including a piston rod and a piston head removably mounted to first end of said piston rod;

a bushing mounted to said piston rod adjacent to said first end of said piston rod; and said piston head forming a stop for one end of said bushing and a break-away stop connected to said piston rod forming a stop for a second end of said bushing.

20. A metering pump according to claim 19 wherein said second end of said cylinder is open.

21. A metering pump according to claim 19 wherein:

said Pump Port includes internal threads terminating adjacent to an internal shoulder;

said cylinder includes at said first end a flange having a first face adjacent to said shoulder of said pump port; and a collar threadably received in said pump port and adjacent to a second face of said flange for securing said flange to said pump port.

22. A metering pump according to claim 21 wherein said flange is a ring extending from a first circumferential groove in said cylinder.

23. A metering pump according to claim 22 wherein said cylinder includes an o-ring extending from a second circumferential groove in said cylinder between said first end and said flange.

24. A metering pump according to claim 19 wherein said piston head includes a first circumferential groove having a cup seal therein and a second circumferential groove with a side formed by said bushing and having a cup seal therein.

25. A metering pump comprising:

a head having an internal chamber interconnecting a pump port, an inlet valve port and an outlet valve port of said head;

a pump cylinder, an inlet valve and an outlet valve removably mounted in said pump port, said inlet valve port and said outlet valve port respectively; and a bore in said head adjacent to said outlet port for receiving a suck-back adjustment device to interact with said outlet valve to adjust the degree of closure of the outlet valve and for receiving a plug threadably received in said bore when no suck-back device is present.

26. A metering pump according to claim 25 including a suck-back device which comprises:

a body threadably received in said bore; and a stem extending through said body from the exterior of said head into the interior of said head for interacting with said outlet valve to adjust the degree of closure of the outlet valve.

27. A metering pump according to claim 26 wherein said stem is movable with respect to said body and including locking means for locking the stem with respect to said body after adjustment.

28. A metering pump according to claim 26 wherein said stem rotates with respect to said body, and including an indicator on said stem external said head for indicating the angular position of said stem.

29. A metering pump according to claim 26 wherein said outlet valve is a check valve, and said stem includes an eccentric cam which interacts with said check valve to adjust the degree of closure of said check valve by rotating said stem.

30. A metering pump according to claim 25 wherein:

said valve ports each include internal threads terminating adjacent to an internal shoulder;

said valves each include a body with a flange at a first end, said flange having a first face adjacent to said shoulder of said valve port; and a collar threadably received in said valve port and adjacent to a second face of a respective flange for securing said respective flange to said valve port.

31. A metering pump according to claim 30 wherein said head is metallic and said collar is non-metallic or other appropriate material to render the threaded joint free from galling.

32. A metering pump according to claim 30 wherein said flange is a ring extending from a first circumferential groove in said valve body.

33. A metering pump according to claim 32 wherein said valve body includes an o-ring extending from a second circumferential groove in said valve body between said first end and said flange.

34. A metering pump according to claim 25 wherein:

said inlet and outlet valves each include a first body member having a first flange adjacent to a first end, and a second body member having a first end receiving said first end of said first body member and receiving a first face of said first flange;

said second body member having a second flange with a first face adjacent to an internal shoulder of said valve port; and a collar is threadably received in said valve port and is adjacent to a second face of said first and second flanges for securing said first and second flanges to a respective port.

35. A metering pump according to claim 34 wherein said second body member includes an o-ring extending from a circumferential groove in said second body member between said flange and said first end.

36. A metering pump according to claim 25 wherein:

said inlet and outlet valves each include an identical first body member having a first valve seat adjacent to its first end, and an identical second body member having a second valve seat adjacent to its first end;

said first and second body members mate at their second ends and said first end of said first body member is in said valve port; and said inlet and outlet valves each include an identical check valve structure which is positioned in said inlet valve body members to seal on said second valve seat and is positioned in said outlet valve body members to seal on said first valve seat.

37. A metering pump according to claim 36 wherein:

said first body member has a first flange with a first face adjacent to an internal shoulder of said valve port;

said second body member includes a second flange adjacent to said second end of said second body member and having a first face received by said second end of said first body member; and a collar threadably received in said valve port adjacent to a second face of said first and second flanges for securing said first and second flanges to said valve port.

38. A metering pump comprising:

a head having an internal chamber interconnecting a pump port, an inlet valve port and an outlet valve port of said head;

a pump cylinder, an inlet valve and an outlet valve removably mounted in said pump port, said inlet valve port and said outlet valve port respectively;

said inlet and outlet valves each including an identical first body member having a first valve seat adjacent to its first end, and an identical second body member having a second valve seat adjacent to its first end;

said first and second body members mating at their second ends and said first end of said first body member being in said valve port; and said inlet and outlet valves each including an identical check valve structure which is positioned in said inlet valve body members to seal on said second valve seat and is positioned in said outlet valve body members to seal on said first valve seat.

39. A metering pump according to claim 38 wherein:

said first body member has a first flange with a first face adjacent to an internal shoulder of said valve port;

said second body member includes a second flange adjacent to said second end of said second body member and having a first face received by said second end of said first body member; and a collar threadably received in said valve port adjacent to a second face of said first and second flanges for securing said first and second flanges to said valve port.

40. A metering pump according to claim 38 wherein said check valve structure includes a poppet comprising:

a seal head of a first diameter;

a stem of a second diameter smaller than said first diameter; and a spring surrounding said stem and extending between said head and a respective valve seat.

41. A metering pump according to claim 40 wherein said stem has deep grooves defining a low helix along its length.

42. A suck-back valve comprising:

a body having an internal chamber interconnecting an inlet valve port and an outlet valve port of said valve;

a valve seat in said body between said ports;

a valve member in said internal chamber; and a stem extending from the exterior of said body into the interior of said body and including an eccentric cam which is extendable through one of said ports and past said valve set to interact with said valve member to adjust the degree of closure of the valve by rotating said stem.

43. A suck-back valve according to claim 41 including locking means for locking the stem with respect to said body after adjustment.

44. A suck-back valve according to claim 42 including an indicator on said stem external said body for indicating the angular position of said stem.

45. A metering pump comprising:

a head having an internal chamber interconnecting a pump port, an inlet valve port and an outlet valve port of said head;

a pump cylinder, an inlet valve and an outlet valve removably mounted in said pump port, said inlet valve port and said outlet valve port respectively;

said inlet and outlet valves being from a group consisting of check valves, duck bill valves and spool valves;

said valve ports have a single design to accept all of said valves; and means independent of said valves for securing any of said valves to said valve ports.

46. A metering pump comprising:

a head having an internal chamber interconnecting a pump port, an inlet valve port and an outlet valve port of said head;

a pump cylinder, an inlet valve and an outlet valve in said pump port, said inlet valve port and said outlet valve port respectively; and mounting means independent of said cylinder, inlet valve and outlet valve for removably mounting said pump cylinder, said inlet valve and said outlet valve in said pump port, said inlet valve port and said outlet valve port respectively and operable by hand without tools.

* * * * *